US008175315B2

(12) United States Patent
Tanaka et al.

(10) Patent No.: US 8,175,315 B2
(45) Date of Patent: May 8, 2012

(54) HEADPHONE SET AND METHOD OF PRODUCING THE SAME

(75) Inventors: Masaaki Tanaka, Yokohama (JP); Makoto Ito, Yokohama (JP); Kunimitsu Okamura, Yokohama (JP); Yuzuko Sasaki, Yokohama (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 868 days.

(21) Appl. No.: 12/221,811

(22) Filed: Aug. 7, 2008

(65) Prior Publication Data

US 2009/0041284 A1 Feb. 12, 2009

(30) Foreign Application Priority Data

Aug. 8, 2007 (JP) ..... 2007-206812
Aug. 21, 2007 (JP) ..... 2007-214908

(51) Int. Cl.
*H04R 25/00* (2006.01)

(52) U.S. Cl. ..... 381/370

(58) Field of Classification Search ..... 381/370–384
See application file for complete search history.

(56) References Cited

U.S. PATENT DOCUMENTS 4,456,797 A * 6/1984 Olsen ..... 381/311
5,692,059 A * 11/1997 Kruger ..... 381/151
6,688,421 B2 2/2004 Dyer et al. ..... 181/130
6,738,487 B1 * 5/2004 Nageno et al. ..... 381/322
7,477,756 B2 * 1/2009 Wickstrom et al. ..... 381/380
7,639,831 B2 * 12/2009 Hagberg ..... 381/380
2007/0116319 A1 * 5/2007 Hagberg ..... 381/380
2011/0211724 A1 * 9/2011 Hirata ..... 381/384

FOREIGN PATENT DOCUMENTS

JP 61113396 A * 5/1986
JP 5-29564 4/1993
JP 05-316583 11/1993
JP 07-050892 2/1995
JP 2000-115876 4/2000
JP 2001-333484 11/2001
JP 2006-203420 8/2006
JP 2008-92356 4/2008
WO WO 95/30320 11/1995

OTHER PUBLICATIONS

Office Action of JP 2007-206812 (with English Translation)—dated Nov. 29, 2011 (6 pages).

* cited by examiner

*Primary Examiner* — Tuyen Nguyen
(74) *Attorney, Agent, or Firm* — Renner, Kenner, Greive, Bobak, Taylor & Weber

(57) ABSTRACT

A headphone set has at least one speaker unit and a housing that encloses the speaker unit. The housing has an elastic protruding portion having a cavity therein. A sound-emitting portion is formed as protruding from a vibrating zone of the speaker unit.

11 Claims, 12 Drawing Sheets

HEADPHONE SET AND METHOD OF PRODUCING THE SAME

CROSS-REFERENCE TO RELATED APPLICATIONS

This application is based on and claims the benefit of priority from the prior Japanese Patent Application No. 2007-206812 filed on Aug. 8, 2007 and No. 2007-214908 filed on Aug. 21, 2007, the entire contents of which is incorporated herein by reference.

BACKGROUND OF THE INVENTION

The present invention relates to a headphone set, and, especially, an inner-ear type headphone set fit in the antihelixes of user's ears comfortably and stably, and a method of producing such a headphone set.

The widespread of portable music players has brought rapid expansion of the market of headphones to be connected to the players. One popular type of headphones is a so-called inner-ear type fit in the antihelixes of user's ears.

Canal-type headphones belonging to the inner-ear type are equipped with: housings enclosing speaker units for converting electrical signals to audio signals; sound emitters protruding from the housings for sound emission; ear pieces coupled to the sound emitters; and cords extending from the housings to transmit audio signals from an external device to the speaker units.

In use of the canal-type headphones, the housings are fit in the antihelixes of user's ears while the sound emitters having the ear pieces are inserted into the ear channels of the ears. The housings are retained inside the antihelixes due to the elasticity of the ear pieces inserted into the ear channels and the friction between the ear pieces and the ear channels. The housings are, however, easily detached from the ears when the cords are pulled.

There are several types of headphones with unique shapes of housings so that the housings are secured inside the antihelixes.

One type of such a headphone structure is disclosed in Japanese Un-examined Patent Publication No. 2006-203420. Earphones disclosed in this document are equipped with elastic loop pinna-support members elastically retained in the antihelixes at a side wall that partitions the concha auriculae and the antitragus.

The loop pinna-support members exhibit high elasticity, or are well deformed, towards the plane created by the loop but low elasticity, or are not deformed well, in directions not parallel to the plane, for example, in the orthogonal direction to the plane.

The elasticity or deformation of the support members depends on the shape and size of users' antihelixes, which causes uncomfortable feelings to some users.

Concerning the deformation discussed above, the earphones disclosed in the document above are well deformed in the two-dimension but not enough in the three-dimension.

In addition, the smaller the pinnas of users, the more the loop pinna-support members have to be deformed. Thus, the more the members are deformed, the more the members exhibit elasticity because they are deformed in the plane discussed above.

Accordingly, a user with small pinnas may have uncomfortable feeling when he or she uses the earphones or suffers a difficulty in using the earphones.

Thus, the earphones disclosed in the document above require improvements in adaptability to users' antihelixes of different shapes and sizes.

SUMMARY OF THE INVENTION

A purpose of the present invention is to provide a headphone set that is easily and comfortably attached to ears of almost any adult users irrespective of the shape and size of the ears, and a method of producing such a headphone set.

The present invention provides a headphone set comprising: at least one speaker unit; a housing that encloses the speaker unit, the housing having an elastic protruding portion having a cavity therein; and a sound-emitting portion formed as protruding from a vibrating zone of the speaker unit.

Moreover, the present invention provides a method of producing an integral housing for a headphone set, the integral housing being composed of an inner housing and an elastic outer housing integral with each other, the method comprising the steps of: forming the inner housing as having an opening at least at a top or a bottom of the inner housing and a through hole at a side wall of the inner housing; fixing an elastic loose core into the through hole; setting the inner housing with the elastic loose core in a mold having a cavity corresponding to an outer shape of the outer housing; molding the outer housing around the inner housing as the integral housing; and pulling out the loose core from the through hole via the opening, thus providing a cavity in the integral housing.

DETAILED DESCRIPTION OF PREFERRED EMBODIMENT

A preferred embodiment of a headphone set according to the present invention will be described with reference to the attached drawings.

Figure 1:
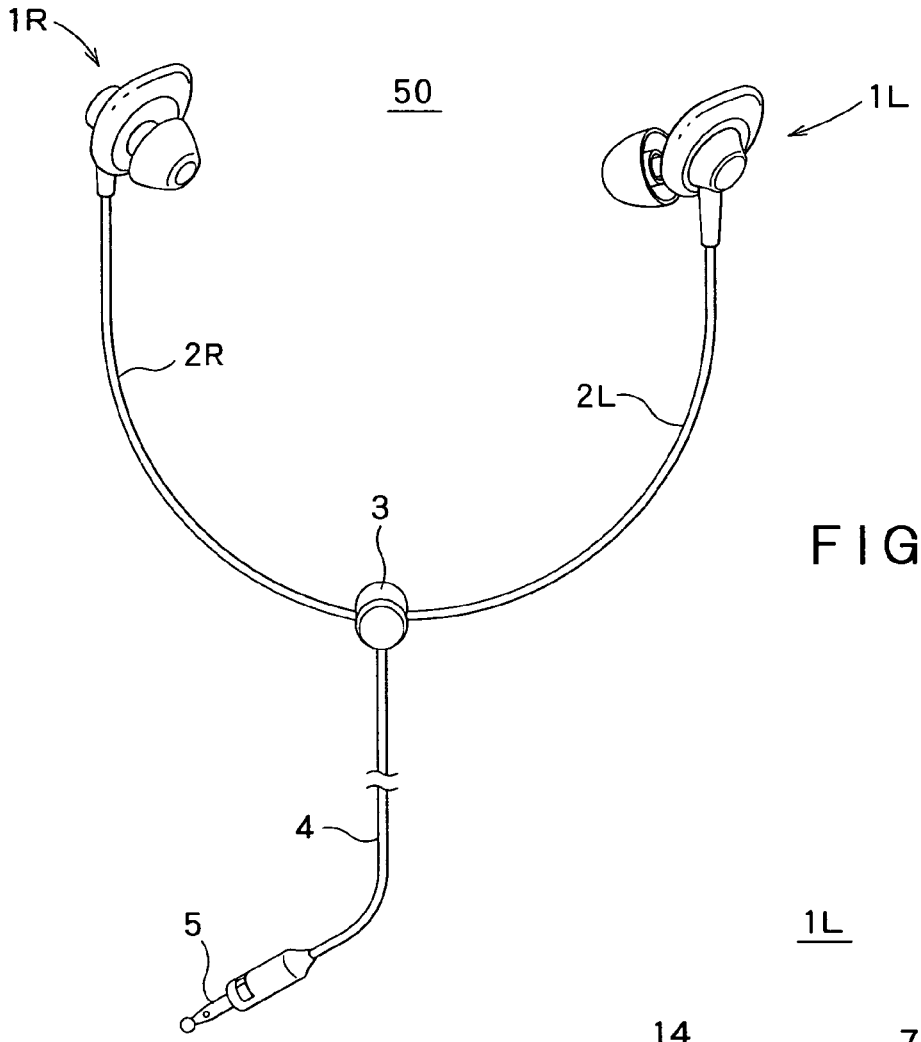
FIG. 1 shows an appearance of a headphone set, a preferred embodiment according to the present invention.

Illustrated in FIG. 1 is an appearance of a headphone set 50, a preferred embodiment according to the present invention.

As shown in FIG. 1, the headphone set 50 is equipped with: left and right speaker sections 1L and 1R; cords 2L and 2R extending from the speaker sections 1L and 1R, respectively; a coupler 3 that couples the cords 2L and 2R together; a plug 5 for connection to external audio equipment; and a main cord 4 that connects the coupler 3 and the plug 5 to each other.

An audio signal from the external audio equipment is transmitted to the coupler 3 via the plug 5 and the main cord 4. Then, L-channel and R-channel audio signal components are supplied to the left and right speaker sections 1L and 1R, respectively, from the coupler 3 through the cords 2L and 2R, respectively, and given off from the speaker sections 1L and 1R, as sounds.

Figure 2:
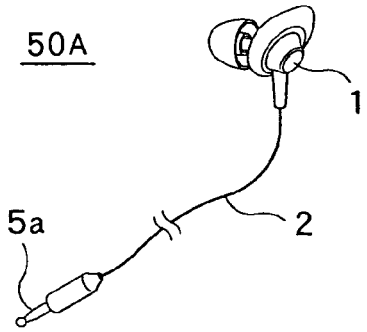
FIG. 2 shows an appearance of a headphone set, a modification in the present invention.

The present invention is applicable not only to the stereo-type headphones, such as the headphone set 50 shown in FIG. 1, but also a headphone set 50A, shown in FIG. 2, which is so-called monaural-type headphones, equipped with: a speaker section 1; a cord 2 extending from the speaker section 1; and a plug 5*a* for connection to an external audio equipment. Moreover, the present invention is applicable to wireless-type headphones equipped with wireless communication means to receive external audio signals, with no cords, plugs, etc.

The headphone set 50, a preferred embodiment according to the present invention, is equipped with the left and right speaker sections 1L and 1R having the identical and symmetrical structure. Thus, the left speaker section 1L will be focused on in the following description.

Figure 3:
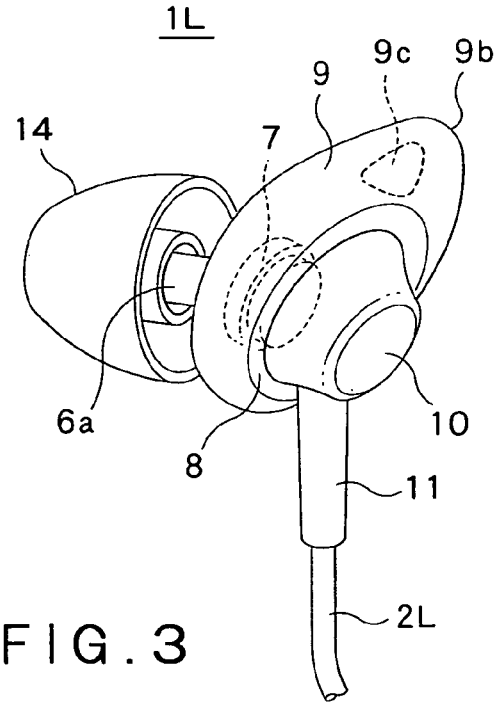
FIG. 3 shows an appearance of a left speaker section of the headphone set, the embodiment according to the present invention.

Illustrated in FIG. 3 is an appearance of the left speaker section 1L of the headphone set 50, viewed from a little bit over the left front of the head of a user when the user attaches the speaker section 1L to his or her left ear.

The left speaker section 1L is equipped with: a speaker unit 7; an inner housing 8 that encloses the speaker unit 7 with a unit holder 6 (shown in FIG. 4); a ring-shaped outer housing 9 formed around the inner housing 8, as integral with the housing 8 by insert molding; an ornament 10 attached to the outer surface of the housing 8; and the cord 2L (already shown in FIG. 1) that supplies external signals to the speaker unit 7.

Figure 4:
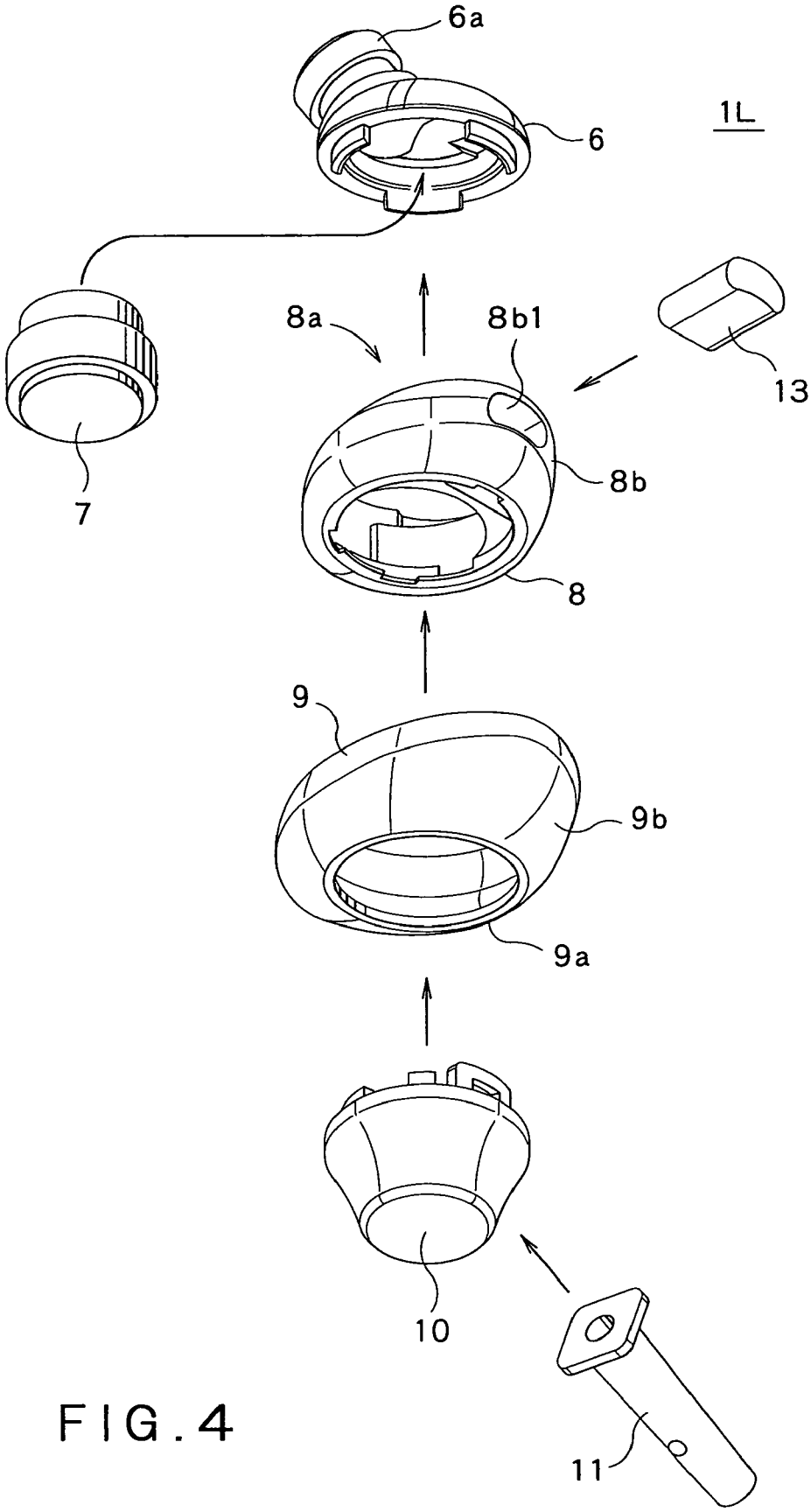
FIG. 4 shows an exploded view of the speaker section of the headphone set, the embodiment according to the present invention.

As shown in FIG. 4, the unit holder 6 has a cylinder-shaped sound-emitting portion 6*a* (also shown in FIG. 3) that gives off sounds from the speaker unit 7, that is a tapered protrusion portion to be inserted into the ear channel of a user's left ear. Attached to the sound-emitting portion 6*a* is an ear piece 14, shown in FIG. 3, that is tightly fit in the ear channel of a user's left ear.

The outer housing 9, as shown in FIG. 3, has a protruding portion 9*b* that sticks out upwards at the back of the head of a user when the user attaches the left speaker section 1L to his or her left ear. Provided inside the protruding portion 9*b* is a cavity 9*c*.

The left speaker section 1L is assembled as described below and as shown in FIG. 4 that is an exploded view of the speaker section 1L. The cord 2L and the ear piece 14 are not shown in FIG. 4.

The speaker unit 7 is fit into the unit holder 6 so that it can give off sounds towards the sound-emitting portion 6*a* of the unit holder 6. The inner housing 8 (with the outer housing 9 formed as integral with the housing 8) is attached to the unit holder 6, as enclosing the speaker unit 7 fit in the unit holder 6. The ornament 10 is attached so that it covers an opening 9*a* of the outer housing 9. A cord bushing 11 is then coupled to the ornament 10, to protect and guide the cord 2L as shown in FIG. 3.

Although the inner and outer housings 8 and 9 are shown in FIG. 4 as separate parts for understanding the assembly, they are formed as a single piece by integral molding as described later.

The assembly of the left speaker section 1L will be described more in detail with reference to FIG. 5. Also in FIG. 5, the inner and outer housings 8 and 9 are shown as separate parts.

Formed firstly by injection molding are the unit holder 6, the inner housing 8, the ornament 10, and the cord bushing 11. Also formed firstly is a loose core 13 (also shown in FIG. 4) to be used in insert molding which will be described later.

A housing 12 is formed by insert molding using the loose core 13 to mold the outer housing 9 as integral with the molded inner housing 8. The housing 12 formed with the inner and outer housings 8 and 9 integral with each other is referred to as an integral housing hereinafter.

The speaker unit 7 is fixed to the unit holder 6, which may be done with an adhesive. The integral housing 12 is then fixed to the unit holder 6 by ultrasonic fusion, which may also be done with an adhesive.

The cord bushing 11 is coupled to the ornament 10. The ornament 10 is then fixed to the integral housing 12 with a snap fit which may have a known hook-and-recess structure (which is not shown in FIG. 4). Instead of a snap fit, the ornament 10 may be fixed to the integral housing 12 with an adhesive.

Figure 5:
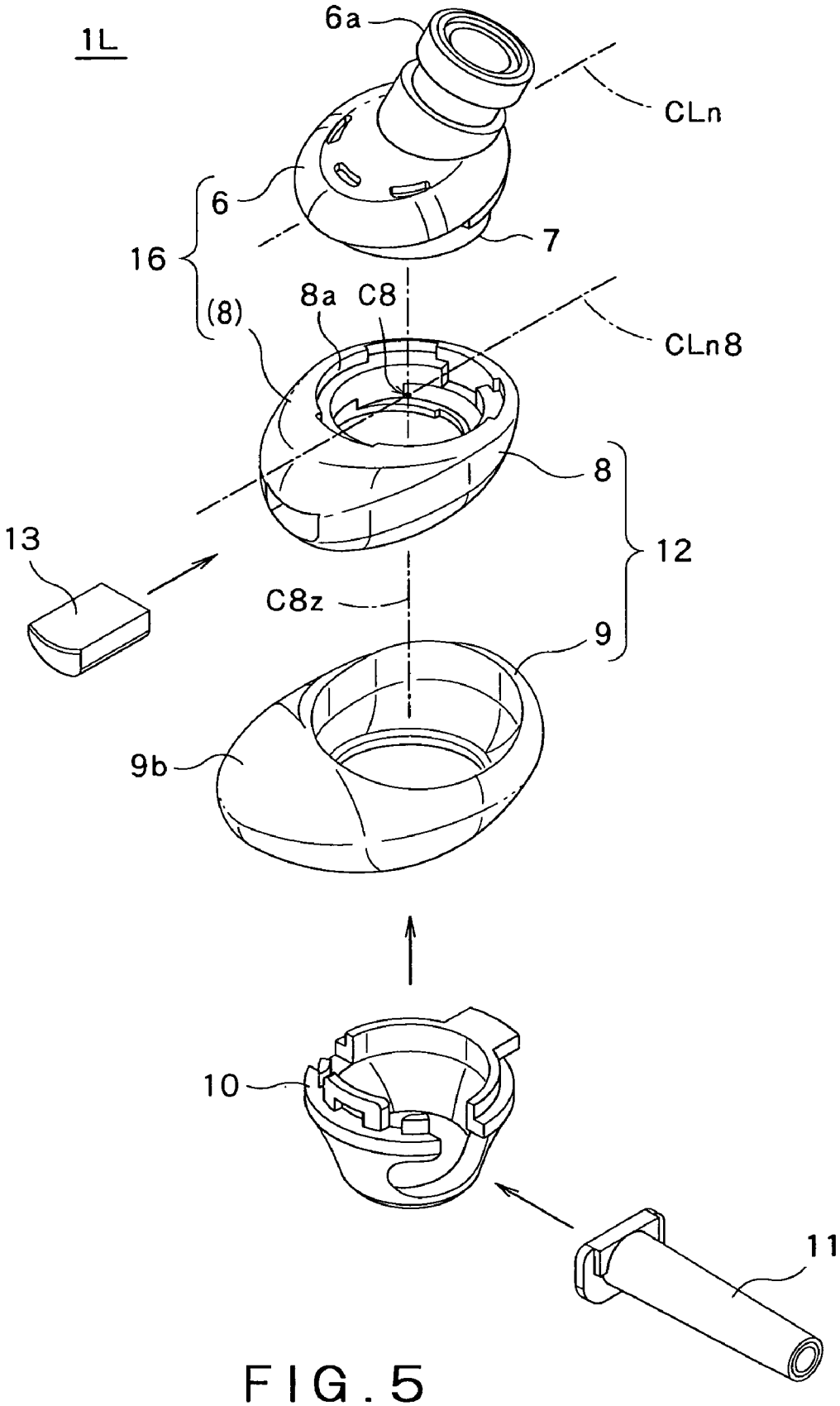
FIG. 5 shows an exploded view of the speaker section of the headphone set, the embodiment according to the present invention.

Although not shown in FIGS. 4 and 5, a lead wire is extended from the speaker unit 7 through openings of the integral housing 12, the ornament 10, and the cord bushing 11, as the cord 2L shown in FIG. 3.

The right speaker section 1R is assembled in the same manner as the left speaker section 1L, with the cord 2R connected thereto.

The cords 2L and 2R are connected to the plug 5, as the main cord 4 via the coupler 3, as shown in FIG. 1.

Assembly of the headphone set 50 is finished through the procedures described above.

The parts of the left speaker section 1L shown in FIGS. 3 to 5 are described in detail.

The unit holder 6 is made of thermoplastic resin, such as, ABS resin (Acrylonitrile Butadiene Styrene), by injection molding. Shown in each of (a) and (b) of FIG. 6 is an appearance of the unit holder 6 viewed from a different angle from FIG. 4.

The unit holder 6 consists of the sound-emitting portion 6*a* shown in FIGS. 3 to 5 and a base portion 6*c* almost flat with an oval-bowl outer shape. The sound-emitting portion 6*a* is provided as being inclined by an angle θ and protruding from a bottom portion 6*c*1 of the base portion 6*c*. The angle θ is, for example, 60 degrees, which is the angle between an long axis CLn of the oval bottom portion 6*c*1 and an axis CL6 perpendicular to the diameter of the sound-emitting portion 6*a*. The angle θ is set so that the sound-emitting portion 6*a* is smoothly and comfortably fit into the ear channel of a user's ear, with the ear piece 14 (FIG. 3), which ear channel is inclined from the left (and right) side of the user's head by 60 degrees more or less. The sound-emitting portion 6*a* has a cylinder-like shape with a smaller-diameter portion 6*a*1 which is engaged with a protrusion (not shown) of the ear piece 14 (FIG. 3), which protects the ear piece 14 from easily detached from a user's ear.

Figure 6:
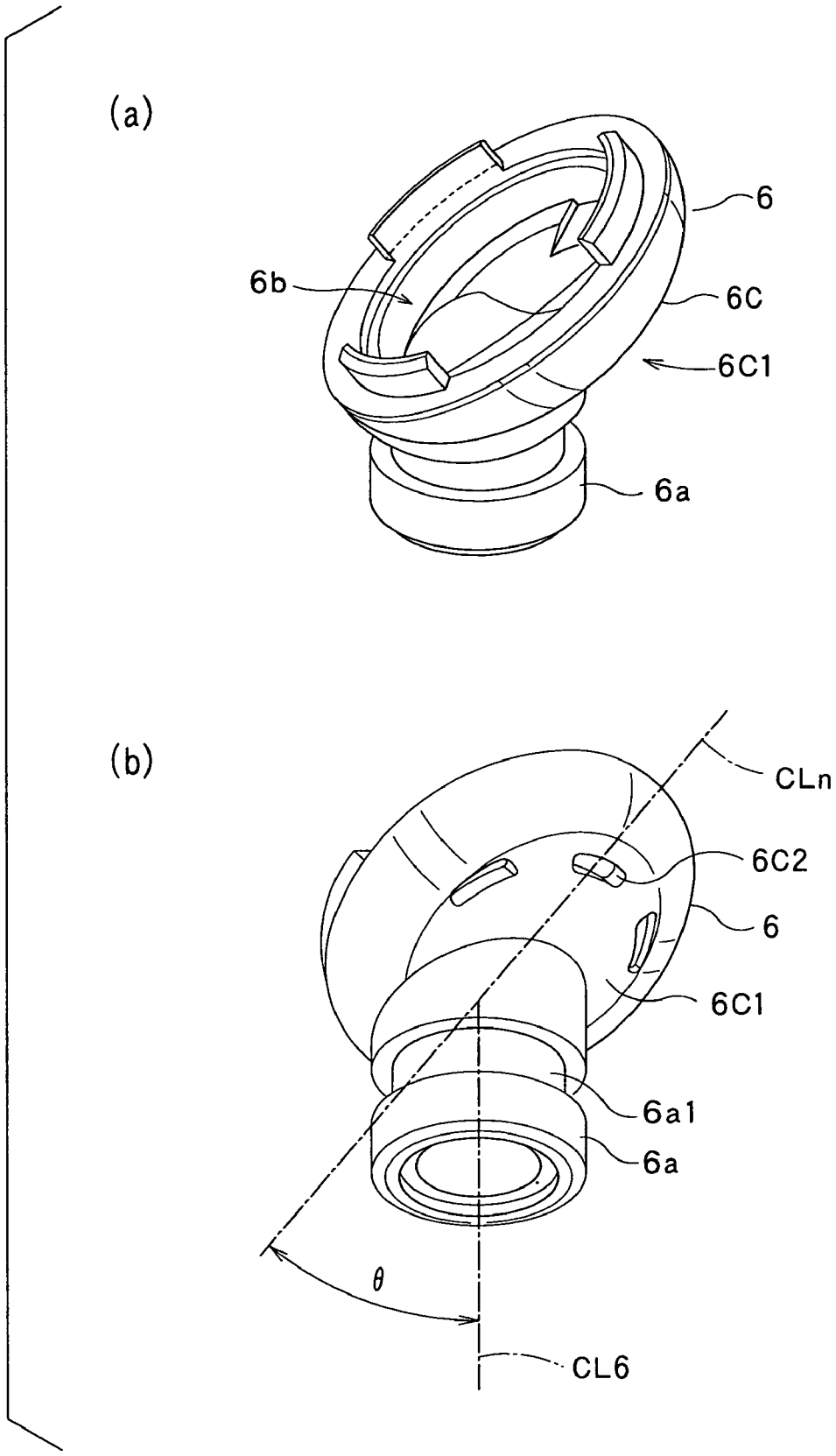
FIG. 6 shows appearances of a unit holder of the headphone set, the embodiment according to the present invention.

Formed inside the base portion 6*c* is a wall 6*b*, as shown in (a) of FIG. 6, so that the speaker unit 7 is tightly attached to the unit holder 6, as shown in FIG. 4. Provided on the bottom portion 6*c*1 are three arc-like openings 6*c*2, as shown in (b) of FIG. 6, that allows the space, created in front of a vibrating zone (a speaker cone) of the speaker unit 7 when the unit 7 is tightly attached to the unit holder 6, to communicate with the external space.

Described next with reference to FIG. 5 are the inner and outer housings 8 and 9.

The outer housing 9 is formed as integral with the inner housing 8 and 9 by insert molding.

Formed first in the insert molding is the inner housing 8 by injection molding with thermoplastic resin. The housing 8 is formed in a ring-like shape, with a circular opening 8*a*, as shown in FIG. 5 that is an exploded view, viewed from different angle from FIG. 4. Thermoplastic resin preferable for the inner housing 8 is PC (polycarbonate), PA (poly amid) or PBT (polybutylene terephthalate). Selection of the material will be discussed later in detail.

In FIG. 5 (and also in FIG. 4), the unit holder 6 is attached to the inner housing 8 at the circular opening 8*a*. Inserted into the opening 8*a* is a part of the speaker unit 7 attached to the unit holder 6 so that the center C8 of the opening 8*a* meets the counterpart of the unit 7, with the axis CL6 of the sound-emitting portion 6*a* shown in (b) of FIG. 6 crossing with an axis C8*z* (FIG. 5) orthogonally passing the center C8. The axis C8*z* agrees with a drive axis (not shown) of the speaker unit 7.

The inner housing 8 has a protruding portion 8*b* that protrudes along an long axis CLn8 that is parallel to the long axis CLn of the oval bottom portion 6*c*1 of the unit holder 6 shown in (b) of FIG. 6 when the holder 6 is attached to the housing 8. The protruding portion 8*b* has an almost hollow portion with a through hole 8*b*1 at its protruding end. The hole 8*b*1 has a long opening in the same direction as the arc-like openings 6*c*2 of the bottom portion 6*c*1 of the unit holder 6, as shown in (b) of FIG. 6.

The outer housing 9 is formed by LIM (Liquid Injection Molding)—insert molding with a thermosetting liquefied silicone material. In detail, the inner housing 8 formed by injection molding is set in an LIM mold. The outer housing 9 is then formed by LIM-insert molding as enclosing a part of the inner housing 8 set in the LIM mold.

A thermosetting liquefied silicone material preferable in this embodiment is a material that exhibits a relatively low hardness that is transformed into a highly elastic silicone rubber after hardened, such as, a liquefied silicone material that exhibits 13 (Shore A) in hardness after hardened. A material that exhibits 10 to 13 (Shore A) in hardness after hardened offers comfortableness to a user because the outer hosing 9 made of such a material is firm but still softly fit the antihelix of a user's ear. Although not limited, the silicone rubber material is the best for the outer hosing 9 for its higher atmospheric corrosion resistance and higher heat resistance, with no harm to users.

The outer housing 9 is formed as tightly fixed to the inner housing 8 in the insert molding. In other words, the material of the inner housing 8 requires to be tightly fixed to the outer housing 9 that is formed with a liquefied silicone material that is hardened with primer application. Among PC (polycarbonate), PA (poly amid), and PBT (polybutylene terephthalate) as the thermoplastic resin for the inner housing 8, PA and PBT are appropriate because they can be tightly fixed to a liquefied silicone material after hardened.

Figure 7:
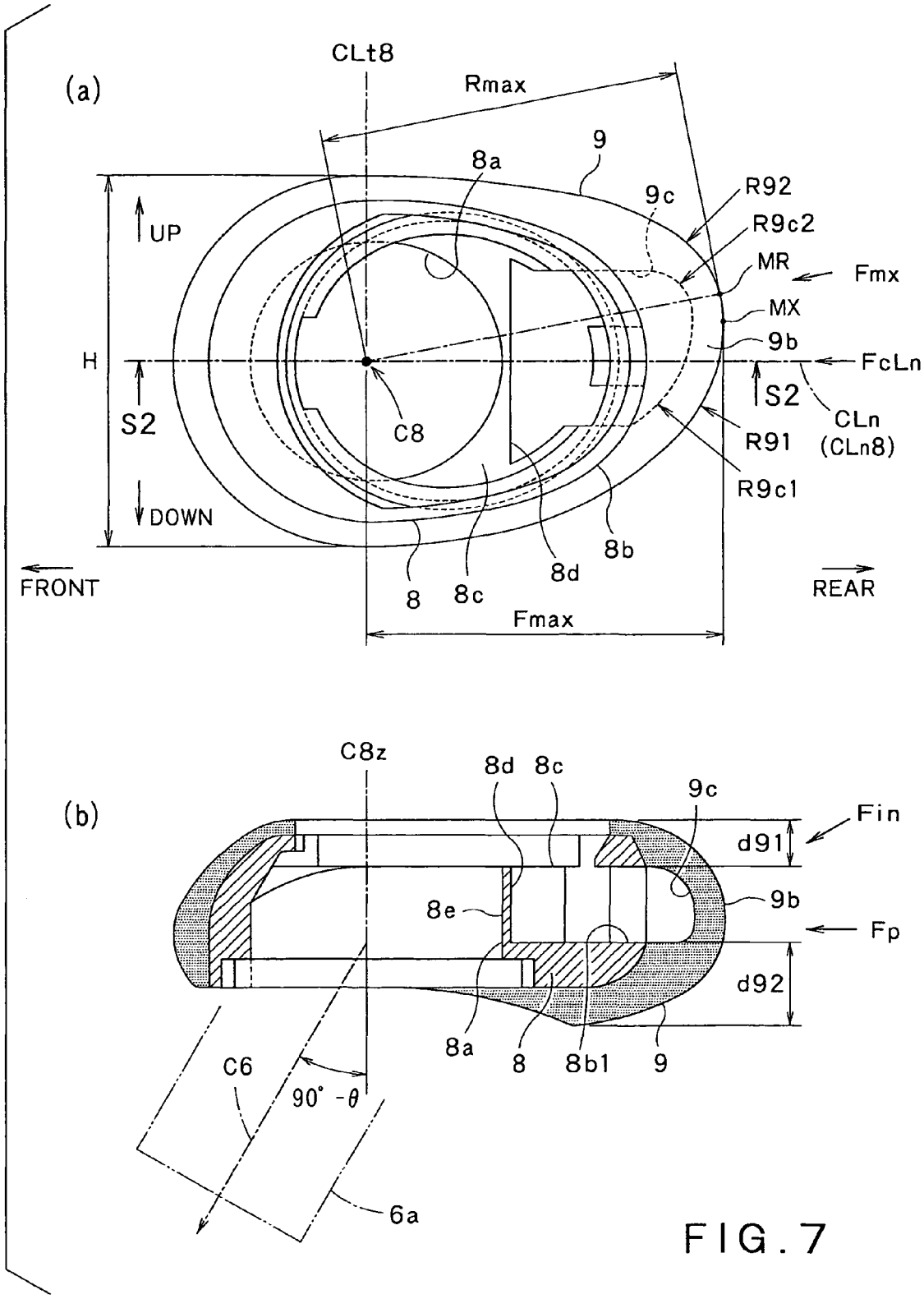
FIG. 7 shows a top view and a longitudinal sectional view of an integral housing of the headphone set, the embodiment according to the present invention.

Described next with reference to FIG. 7 is the integral housing 12 formed with the inner and outer housings 8 and 9.

Shown in (a) of FIG. 7 is a top view of the integral housing 12 viewed from the ornament 10 side (FIG. 3) when a user attaches the left speaker section 1L on his or her left ear. Shown in (b) of FIG. 7 is a longitudinal sectional view taken on line S2-S2 of (a) of FIG. 7. The signs UP, DOWN, FRONT, and REAR in (a) of FIG. 7 indicate the directions of the user's head, neck, face, and the back of the head, respectively.

The outer housing 9 has an asymmetrical outer appearance, as shown in (a) of FIG. 7, with the protruding portion 9*b* that protrudes as inclined to the direction UP a little bit compared to the protruding portion 8*b* of the inner housing 8.

The outer housing 9 is adjusted as described below with respect to the inner housing 8, to have the asymmetrical outer appearance.

A point MR of the protruding portion 9*b* that is most distant from the center C8 of the opening 8*a* of the inner housing 8 in the direction REAR is not located on the long axis CLn but above the axis CLn in the direction UP, with a distance Rmax from the center C8 to the point MR.

A point Mx of the protruding portion 9*b* that is most distant from a short axis CLt8 passing the center C8 and intersecting with the long axis CLn8 of the inner housing 8 is not located on the long axis CLn but above the axis CLn in the direction UP, with a distance Xmax from the center C8 to the point Mx.

In summary, the outer housing 9 is adjusted as having the points MR and Mx most distant from the center C8 and the short axis CLt8, respectively, located above the long axis CLn in the direction UP that is opposite to the direction FRONT in which the sound-emitting portion 6*a* is inclined, as shown in (a) of FIG. 7.

The integral housing 12 is provided with the cavity 9*c*, as shown in FIG. 3, in the protruding portion 9*b* of the outer housing 9. The cavity 9*c* is provided by insert molding using a liquefied silicone material, as described below.

Prepared is the loose core 13 having the shape identical to the cavity 9*c*. The loose core 13 is then inserted from outside into the through hole 8*b*1 of the inner housing 8 already formed, as shown in FIG. 4, the through hole 8*b*1 being situated at a location of the cavity 9*c* to be provided.

The inner housing 8 having the loose core 13 is set in an insert mold having a cavity corresponding to the outer shape of the integral housing 12. The insert mold is then heated to a specific temperature range. A liquefied silicone material is injected into the heated mold cavity, to be molded into the outer housing 9.

Before the insert molding to form the outer housing 9, the inner housing 8 is subjected to primer application at its zone to be touched with the liquefied silicone material for higher contactness between the housing 8 and the material.

The molded integral housing 12 is removed from the insert mold. The loose core 13 is then pulled out from the inner housing 8. It is made of a thermosetting liquefied silicone material exhibiting a high flexibility, the same as the material of the outer housing 9, thus can be easily deformed and pulled out from the inner housing 8.

The integral housing 12 formed by insert molding using the loose core 13 described above is provided with a space inside the inner housing 8 and the cavity 9*c* of the outer housing 9 communicating with each other.

The loose core 13 can be used repeatedly in high-temperature LIM molding because it is made of a thermosetting liquefied silicone material that exhibits excellent heat resistance characteristics after hardened. The loose core 13 is made of the same material as the outer housing 9 so that there is almost no attachment therebetween and it can be easily pulled out from the inner housing 8, or the mold.

An alternative to the liquefied silicone material is TPE (Thermo Plastic Elastomer). TPE is flexible but exhibits low affinity with the liquefied silicone material. Thus, the TPE-made loose core 13 can be easily removed from the mold without being attached to the outer housing of the liquefied silicone material. TPE is a thermo plastic material, thus not appropriate for repeated use whereas advantageous over the liquefied silicone material on cost performance.

In contrast, an inflexible material, such as, a thermo-setting and heat-resistant phenolic resin, is not a good choice for the loose core 13 in relation to the flexible outer housing 9 made of the liquefied silicone material. Such a loose core made of an inflexible material requires a specific space in the integral housing 12 so that it can be smoothly pulled out from the inner housing 8. It is, however, difficult to provide such a specific space in a headphone speaker unit, especially, for inner-ear type headphones.

A flexible material described above is a better choice for the loose core 13 which requires a smaller space to be pulled out.

The cavity 9*c* (a hollow space) shown in FIG. 3 and the through hole 8*b*1 shown in FIGS. 4 and 5 communicates with each other to create a space which is an undercut feature in injection molding of the integral housing 12.

Such an undercut feature gives specific requirements to an injection mold. And, known techniques to provide a hollow space use inner slide cores or cores disclosed, for example, in a Japanese Utility Model laid-open No. 5 (1993)-29564.

Such cores used in the known techniques cannot be used for the speaker sections 1L and 1R of the headphone set 50 because the speaker sections are extremely small parts that can be fit inside the antihelixes of user's ears.

The present invention employs a flexible loose core for providing the cavity 9*c* in which the loose core is deformed and pulled out from a tiny space created in the inner housing 8 after insert molding.

This process will be described in detail with reference to FIG. 8 which shows the molded inner housing 8, the loose core 13 to be fit into to the housing 8, and also the unit holder 6.

Figure 8:
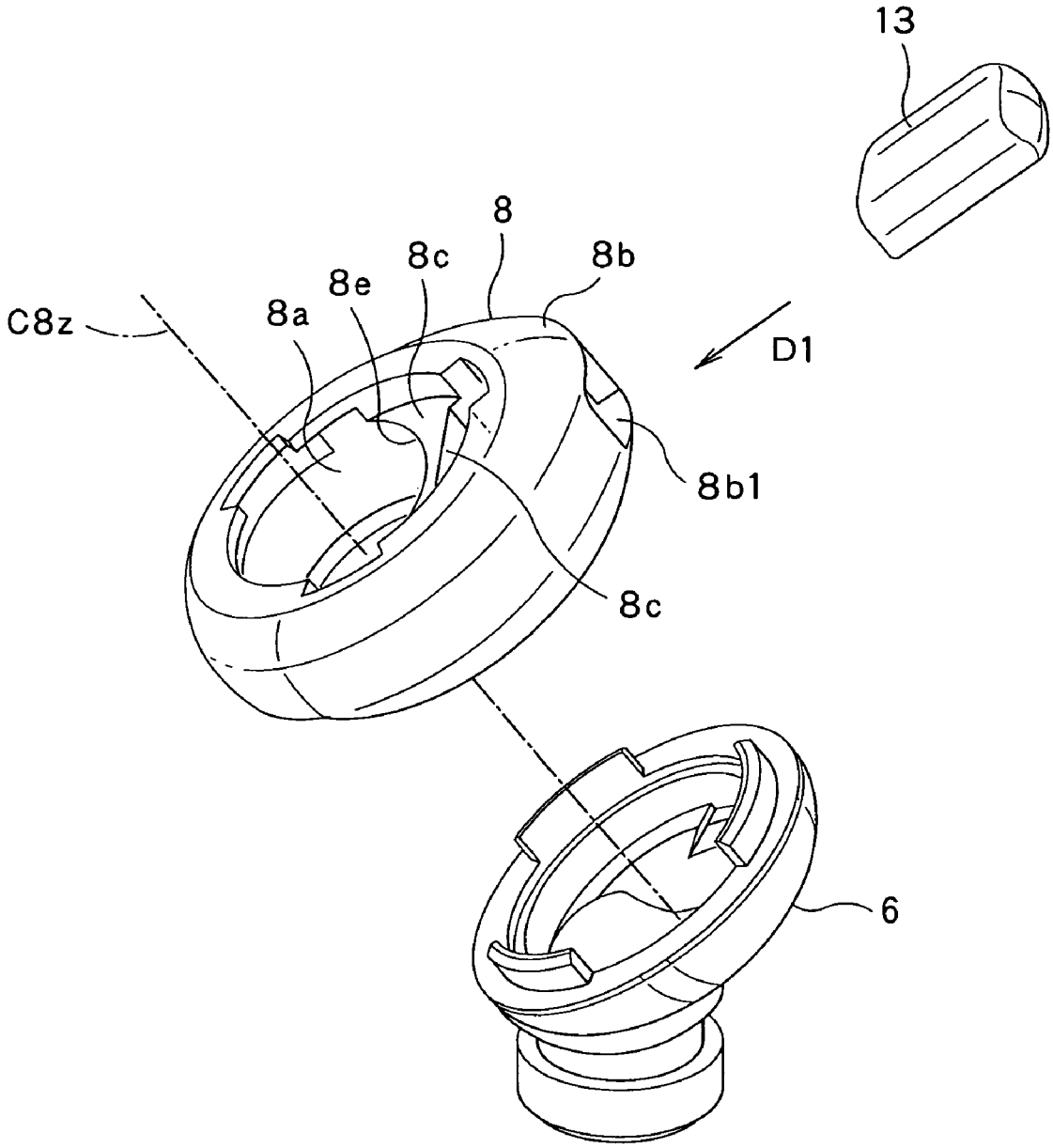
FIG. 8 shows a view illustrating insertion of a loose core into a molded inner housing of the headphone set, the embodiment according to the present invention.

As shown in FIG. 8, the inner housing 8 has the circular opening 8*a* with the center axis C8*z* that agrees with a drive axis (not shown) of the speaker unit 7 (FIG. 5).

Moreover, the inner housing 8 has a shelf portion 8*c* to accept the ornament 10, as shown in FIG. 5. The shelf portion 8*c* sinks inside the inner housing 8 so as to correspond to the outer shape of the housing 8. Provided at the tip of the protruding portion 8*b* that is a part of the shelf portion 8*c* is a pull-out hole 8*d*, through which the loose core 13 is to be pulled out, communicated with the through hole 8*b*.

Although the speaker sections 1L and 1R carry several parts inside, the size of the speaker sections 1L and 1R is limited for use in inner-ear type headphones.

Nevertheless, a larger-diameter speaker unit 7 is preferable for higher sound quality. The opening 8*a* of the inner housing 8 accepts the speaker unit 7 made lager as much as possible, as shown in FIG. 5, while at least side faces of such a larger speaker unit 7 have to be covered by the wall of the housing 8. Thus, the housing 8 requires a partition 8*e* that separates the opening 8*a* and the pull-out hole 8*d*, for high performance of the speaker unit 7. The size and capacity of the hole 8*d* are inevitably limited.

Figure 9:
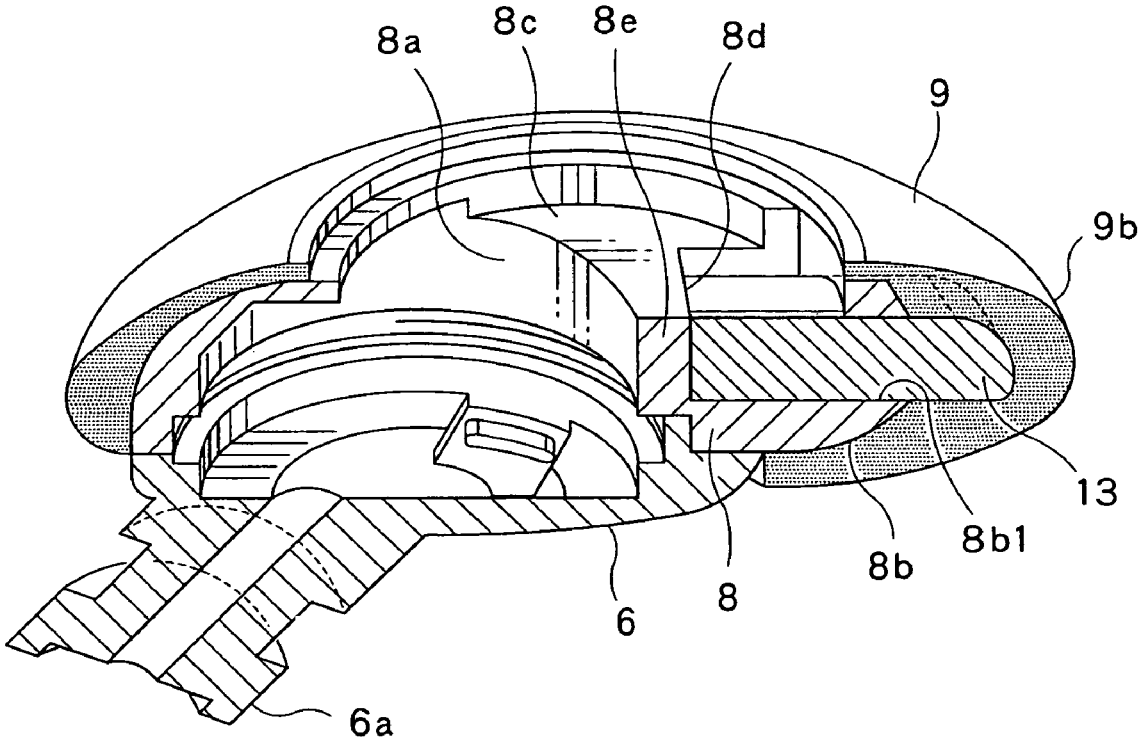
FIG. 9 shows a view of a molded outer housing of the headphone set, the embodiment according to the present invention.

As shown in FIG. 8, the loose core 13 is fit into the through hole 8*b*1 in a redirection D1 before insert molding, for providing the cavity 9*c* (FIG. 3). Thereafter, the outer housing 9 is molded which is shown in FIG. 9. Also shown in FIG. 9 is the unit holder 6 that is attached to the inner housing 8 after the loose core 13 is pulled out. The speaker unit 7 is not shown here.

After the outer housing 9 is molded, the loose core 13 has to be pulled out inside the housing, because the outer opening of the through hole 8*b*1 is covered by the housing 9.

If the loose core 13 is inflexible, it is difficult to pull out the core 13 in the direction D1 through the small pull-out hole 8*d* via the partition 8*e*.

However, since the loose core 13 in this embodiment is made as flexible to be easily deformed, it can be easily pulled out in the direction D1 through the small pull-out hole 8*d*.

Figure 10:
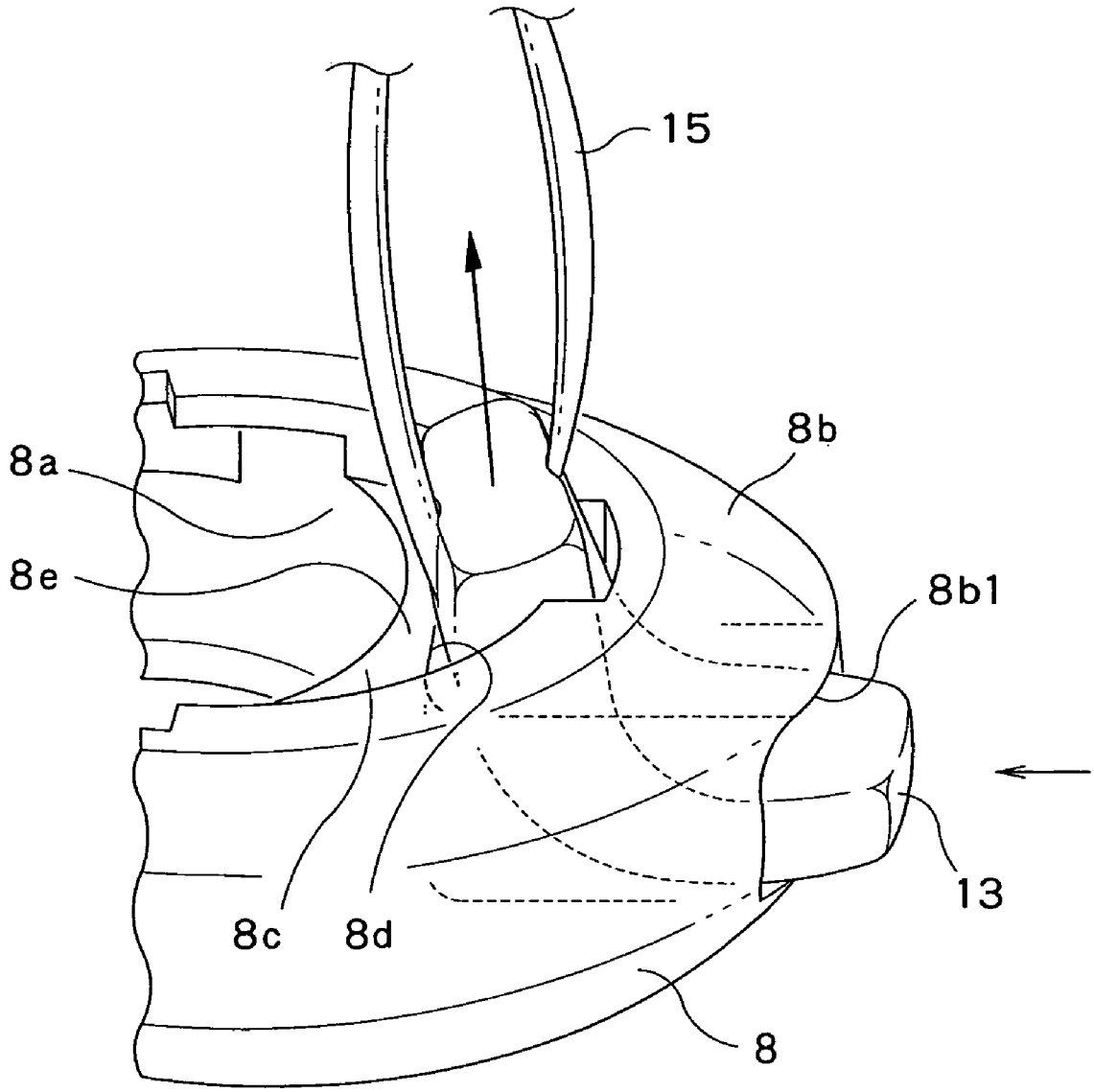
FIG. 10 shows a view illustrating pulling-out of the loose core in the headphone set, the embodiment according to the present invention.

Illustrated in FIG. 10 is that the loose core 13 is pulled out with a tweezers-like tool 15. The outer housing 9 is not shown in FIG. 10 for clear illustration. The flexible core 13 can be pinched by any tool having sharp edges at any point besides illustrated.

Figure 11:
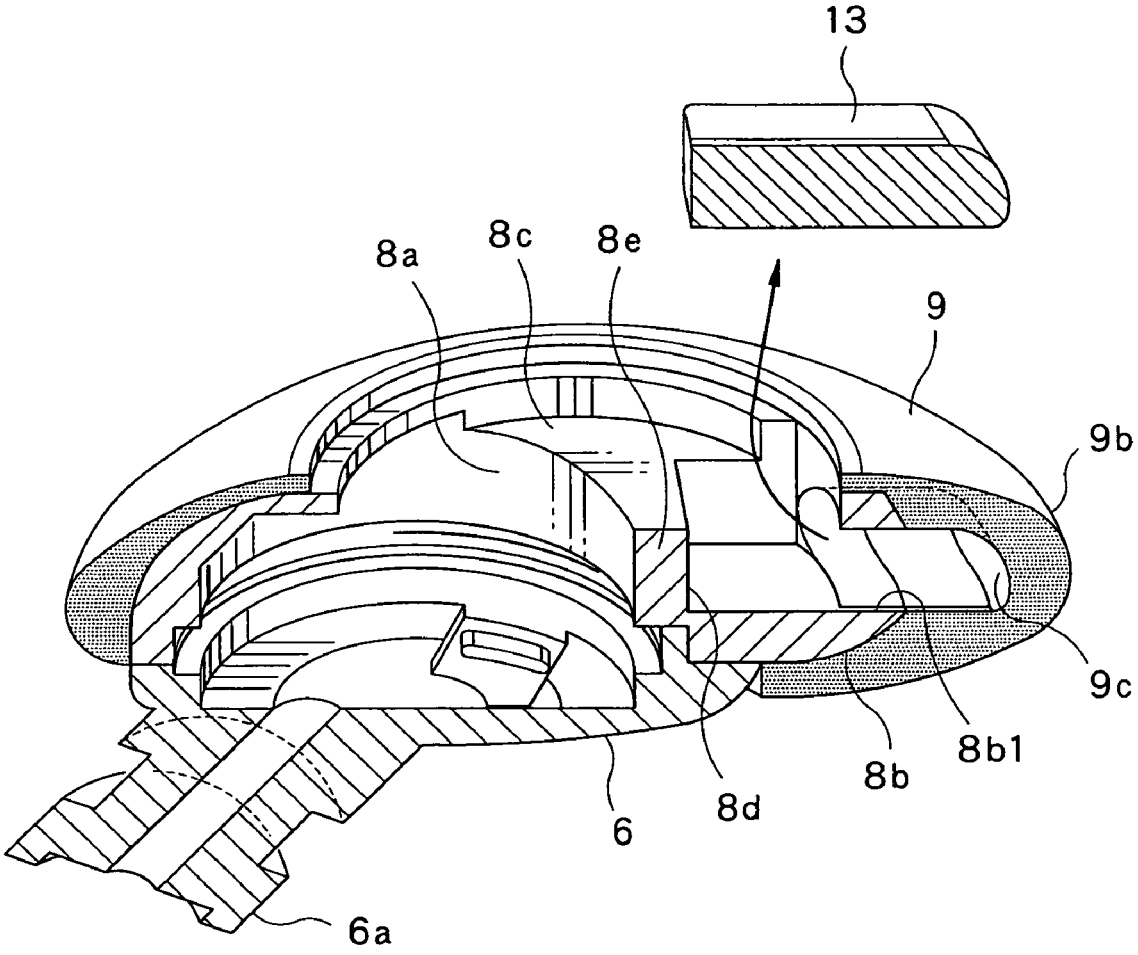
FIG. 11 shows a partially cutaway view of the outer housing after the loose core is pulled out, in the headphone set, the embodiment according to the present invention.

Illustrated in FIG. 11 is a partially cutaway view of the outer housing 9 after the loose core 13 is pulled out, with the unit holder 6 being shown. The speaker unit 7 is not shown here.

What is provided inside the protruding portion 9*b* of the outer housing 9 is the cavity 9 having the shape of the pulled-out loose core 13.

Figure 12:
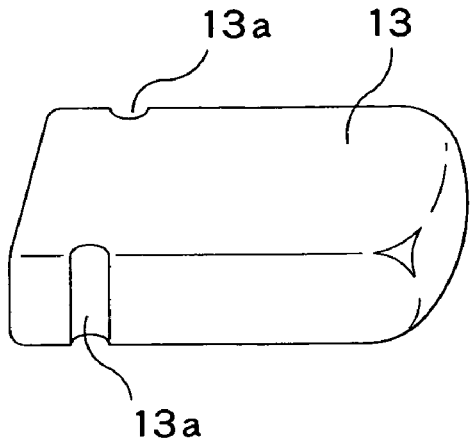
FIG. 12 shows a view illustrating a modification to the loose core.
Figure 13:
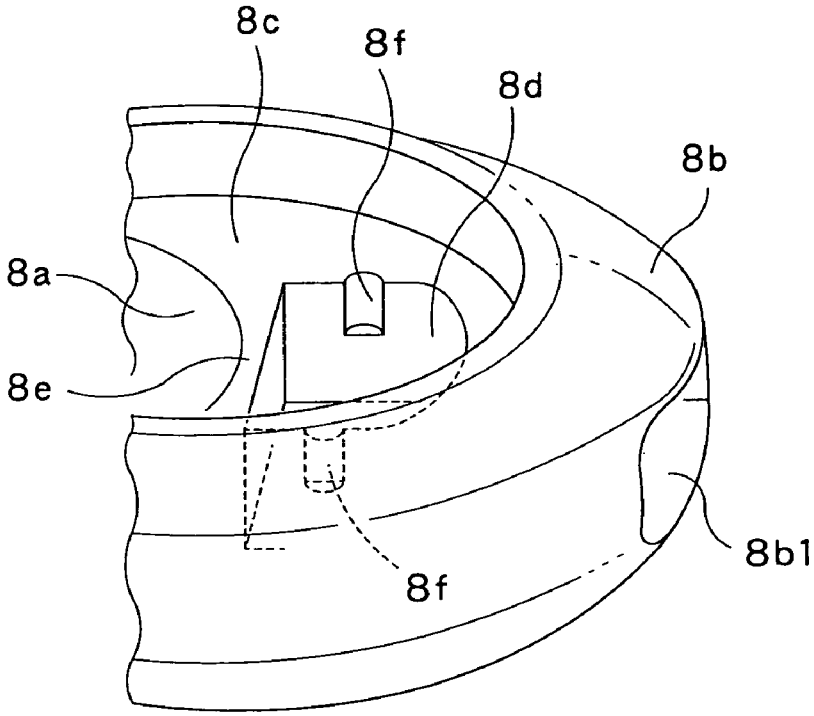
FIG. 13 shows a view illustrating a modification to an inner housing of the headphone set, the embodiment according to the present invention.

The loose core 13 may have caved-in portions 13*a*, as shown in FIG. 12, so that it is easily pulled out. Or, the pull-out hole 8*d* may have convex portions 8*f*, as shown in FIG. 13, so that the loose core 13 can be easily pinched by a tool, as illustrated in FIG. 10. Moreover, the flexible loose core 13 can be sucked out, instead of using the tweezers-like tool 15.

Discussed next is the location of the cavity 9*c* that is provided as displaced from the center of the outer housing 9, as shown in FIG. 3.

In (a) of FIG. 7, the width H of the outer housing 9 in the FRONT side is 12 mm, with 11 mm in the distance Xmax, in this embodiment.

The requirements of the cavity 9*c* in (a) of FIG. 7 are as follows:

Below the long axis CLn in the top view, a curvature R9*c*1 of the cavity 9*c* is smaller than a curvature R91 of the protruding portion 9*b*.

Above the long axis CLn in the top view, a curvature R9*c*2 of the cavity 9*c* is smaller than a curvature R92 of the protruding portion 9*b*.

Under the requirements, the protruding portion 9*b* of the outer housing 9 is formed as having the cavity 9*c*, as shown in (b) of FIG. 7, such that it is thinnest in a zone between the points Mx and MR already defined with reference to (a) of FIG. 7 and is gradually thicker in the upper and lower zones with respect to the zone between the points Mx and MR.

Therefore, the protruding portion 9*b* of the outer housing 9 having the cavity 9*c* is most deformable in the zone between the points Mx and MR above the long axis CLn in the top view in (a) of FIG. 7. When the left speaker section 1L is fit in the antihelix of a user's left ear, the following forces are generated due to deformation of the protruding portion 9*b* inside the concha: a force FCLn in the direction of the long axis CLn; and a force FMx in the direction a little bit above the force FCLn, in the top view in (a) of FIG. 7, which are the repulsion forces towards the center C8.

The force FMx is applied to push the left speaker section 1L between the tragus and antitragus of a user's left ear, thus the speaker section 1L being stably held inside the antihelix. This pushing action with the force FMx (which is referred to as a first pushing action hereinafter) will be discussed later with reference to FIG. 14.

The repulsion forces towards the center C8 is discussed further with reference to (b) of FIG. 7 that is a longitudinal sectional view taken on line S2-S2, or the long axis CLn, in (a) of FIG. 7. Illustrated in (b) of FIG. 7 is a longitudinal sectional view of the left speaker section 1L viewed from the ground when the speaker section 1L is attached to a user's left ear.

As described with reference to (a) of FIG. 7, the protruding portion 9*b* of the outer housing 9 is formed as having the cavity 9*c*, such that it is gradually thicker in the upper and lower zones with respect to the zone between the points Mx and MR.

Moreover, as shown in (b) of FIG. 7, the protruding portion 9*b* is formed with the cavity 9*c* as having the upper zone with a thickness d91 and the lower zone with a thickness d92 thicker than the thickness d91. In other words, the upper zone which is apart from the user's head is formed as thinner than the lower zone closer to the user's head.

Therefore, the protruding portion 9*b* is easily deformed in the upper zone (having the cavity 9*c*) that is apart from the sound-emitting portion 6*a* compared to the zone closer to the portion 6*a* in (b) of FIG. 7.

In detail, the protruding portion 9*b* is deformed within the concha of a user's left ear when the left speaker section 1L is attached to the left ear, to generate forces Fp and Fin as the repulsion forces towards the center C8, as shown in (b) of FIG. 7. The force Fp is applied in the direction orthogonal to an axis C8*z*. The force Fin is applied from above the force Fp, as indicated in (b) of FIG. 7.

The force Fin acts to push the sound-emitting portion 6*a* into the ear channel so that the portion 6*a* cannot be easily pulled out therefrom, thus the left speaker section 1L can be stably held within the antihelix. This pushing action with the force Fin (which is referred to as a second pushing action hereinafter) will be discussed later with reference to FIG. 14.

The advantages of the headphone set 50, a preferred embodiment according to the present invention, described above are further discussed with reference to FIG. 14.

Figure 14:
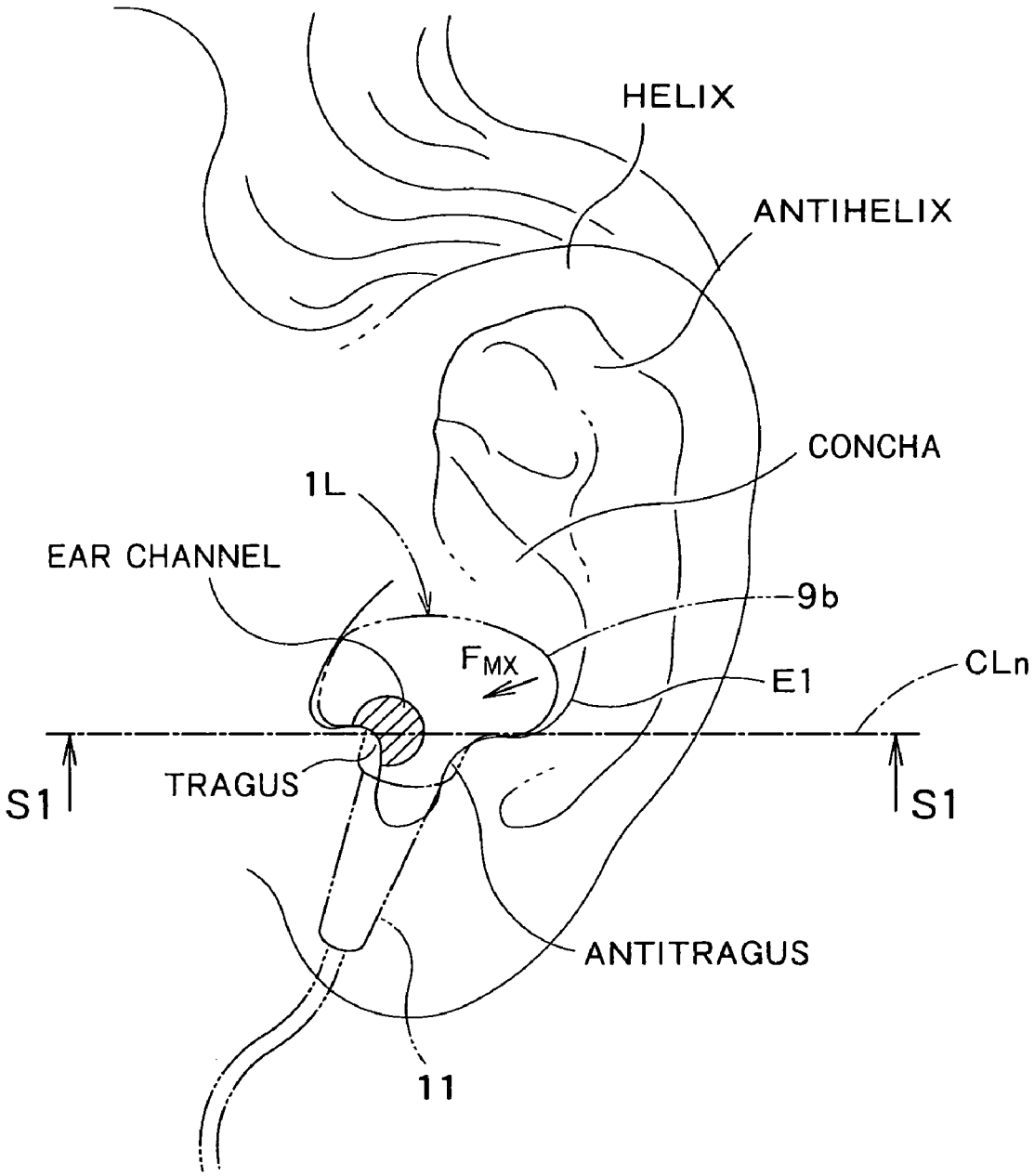
FIG. 14 shows a view illustrating how a force is applied in a user's ear.

Illustrated in FIG. 14 is an appearance of a user's left ear with the left speaker section 1L attached thereto and indicated by a dashed line, without showing the sound-emitting portion 6*a* inserted into the ear channel with the ear piece 14.

The protruding portion 9*b* of the outer housing 9 is formed in a size so that it can be attached to a side wall E1 in the concha of almost any adults irrespective of the concha size. Thus, the speaker section 1L can be attached to a user's ear while the elastic protruding portion 9*b* is deformed as if it is crushed inside the concha and attached to the side wall E1. The deformation is achieved with the structure in that the cavity 9*c* is provided inside the protruding portion 9*b* of the outer housing 9 made of a highly flexible material.

Discussed next is the first pushing action of the force FMx. The force FMx is generated by the deformation described above which is achieved with the cavity 9*c* provided as displaced from the long axis CLn towards the direction UP (towards the vertex of a user), as indicated in (a) of FIG. 7. The force FMx is then applied to the speaker section 1L from above, as indicated by an arrow in (a) of FIG. 7, towards the ear channel so that the speaker section 1L is pressed between the tragus and antitragus and stably held therein. This is the first pushing action of the force FMx.

Figure 15:
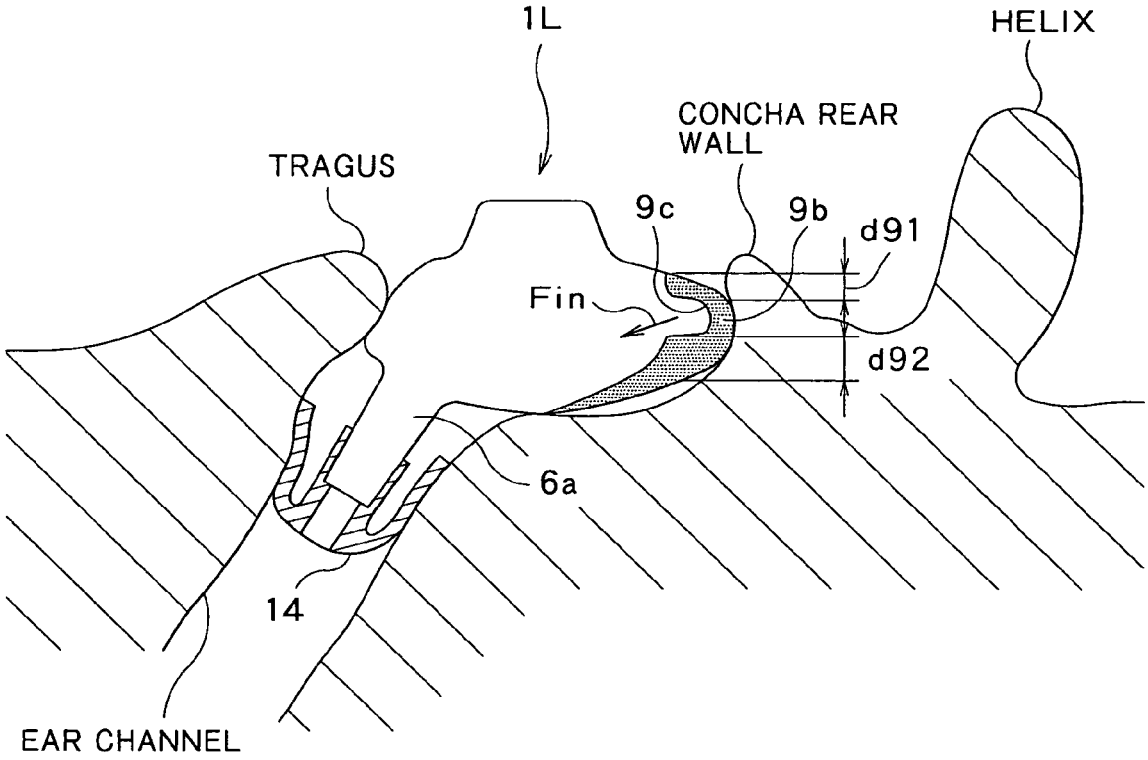
FIG. 15 shows a view illustrating how a force is applied in a user's ear.

Discussed next with reference to FIG. 15 is the second pushing action of the force Fin. FIG. 15 is a sectional view, taken on line S1-S1 of FIG. 14, showing a part of the left speaker section 1L attached to a user's left ear.

The force Fin is generated by the deformation described above which is achieved with the protruding portion 9*b* formed with the cavity 9*c* as having the thickness d92 closer to the user's head and the thickness d91 farther from the head and thinner than the thickness d92, also shown in (b) of FIG. 7. The force Fin is then applied to the speaker section 1L from outside to the user's head, as indicated by an arrow in FIG. 15, so that the sound-emitting portion 6*a* is pushed into the ear channel with the ear piece 14, thus the speaker section 1L being stably held within the antihelix without the portion 6*a* being not easily pulled out from the ear channel. This is the second pushing action of the force FMx.

A flexible and transparent material for the outer housing 9 allows a user to observe the cavity 9*c* inside the protruding portion 9*b* and realize the flexibility of the portion 9*b*. Such a transparent housing 9 become a good sales point because the cavity 9*c* is one factor of the adaptability of the headphone set 50.

The adaptability is achieved with the protruding portion 9*b* that is fit in the concha and can be three-dimensionally deformed so that the headphone set 50 can be used for almost any adult users irrespective of differences in ear size or shape. The three-dimensional deformation allows the speaker units 1L and 1R to be attached to the user's ears comfortably and firmly without not easily pulled out from the ears even if the cords are pulled because of the forces generated towards the ear channels discussed above.

It is understood that by those skilled in the art that the foregoing description is a preferred embodiment of the present invention and that various changes and modifications may be made in the invention without departing from the sprit and scope thereof.

For example, the cavity 9*c* may be filled with air or any substance unless it gives an adverse effect to the flexibility of the protruding portion 9*b* of the outer housing 9. Such a substance may be a colored gel. It can be an accent color in design if filled in the cavity 9*c* of a transparent outer housing 9.

Moreover, a photo-emitter, such as, an LED, may be provided in the cavity 9*c*, which can be turned on and off with a given pattern, such as a pattern based on audio signals supplied to the speaker unit 7. Such a photo-emitter recognizable from outside a transparent outer housing 9 can be attractive as the feature of the headphone set 50 and useful at night.

Furthermore, the cavity 9*c* may be a completely enclosed space filled with air or another gas. Such a completely enclosed cavity 9*c* generates a repulsion force in addition to the forces discussed above when the air (or another gas) is pressured due to deformation of the protruding portion 9*b* when the speaker sections 1L and 1R are attached to the user's ears. Such a completely enclosed cavity 9*c* allows the outer housing 9 to be formed thinner while maintaining the several advantages of the headphone set 50, described above.

As disclosed above in detail, the present invention provides a headphone set that can be fit to almost any adult users irrespective of the shape or size of the ears of users.

What is claimed is:

1. A headphone set comprising:

at least one speaker unit;

a housing that encloses the speaker unit, the housing having an elastic protruding portion having a cavity therein; and a sound-emitting portion formed as protruding from a vibrating zone of the speaker unit, wherein the protruding portion is provided so that a force is generated from the protruding portion and applied to a tragus and an antitragus of an ear of a user when the user puts on the headphone set due to deformation of the protruding portion, the deformation occurring when the sound-emitting portion is inserted into an ear channel of the ear while the protruding portion is fit in a concha of the ear.

2. The headphone set according to claim 1, wherein the protruding portion is formed so that the housing has an asymmetrical shape on both sides of a longitudinal axis of the housing.

3. The headphone set according to claim 2, wherein the housing has a circular opening having a center from which the protruding portion is extending, and the cavity is provided in a specific zone of the protruding portion, the specific zone being at least partially displaced from the longitudinal axis and at least interposed between a first line connecting the center of the circular opening and a first point of the protruding portion most distant from the center and a second line connecting the center and a second point of the protruding portion most distant from a traversal axis of the housing.

4. The headphone set according to claim 2, wherein the protruding portion is provided so that a force is generated from the protruding portion and applied to the sound-emitting portion to push the sound-emitting portion into an ear channel of an ear of a user when the user puts on the headphone set due to deformation of the sound-emitting portion, the deformation occurring when the sound-emitting portion is inserted into the channel while the protruding portion is fit in a concha of the ear.

5. The headphone set according to claim 3, wherein the protruding portion is thinner in the specific zone than another zone of the protruding portion, the zones being located on opposite sides of the longitudinal axis.

6. The headphone set according to claim 1, the protruding portion is made of a silicone rubber.

7. A method of producing an integral housing for a headphone set, the integral housing being composed of an inner housing and an elastic outer housing integral with each other, the method comprising the steps of:

forming the inner housing as having an opening at least at a top or a bottom of the inner housing and a through hole at a side wall of the inner housing;

fixing an elastic loose core into the through hole;

setting the inner housing with the elastic loose core in a mold having a cavity corresponding to an outer shape of the outer housing;

molding the outer housing around the inner housing as the integral housing; and pulling out the loose core from the through hole via the opening, thus providing a cavity in the integral housing.

8. The method according to claim 7, wherein the outer housing is molded as having an elastic protruding portion so that the outer housing has an asymmetrical shape on both sides of a longitudinal axis of the outer housing.

9. The method according to claim 8, wherein the protruding portion is formed as thinner in a specific zone than another zone of the protruding portion, the zones being located on opposite sides of the longitudinal axis.

10. The method according to claim 8, wherein the cavity of the integral housing is provided in a specific zone of the protruding portion, the specific zone being at least partially displaced from the longitudinal axis.

11. The method according to claim 7 further comprising the step of forming the loose core with a material of liquefied silicone or thermo plastic elastomer.

* * * * *